United States Patent [19]

Wilkinson

[11] Patent Number: 4,899,771

[45] Date of Patent: Feb. 13, 1990

[54] WALKING AID

[76] Inventor: Kenneth A. Wilkinson, 10230 La Canada Way, Shadow Hills, Calif. 91040

[21] Appl. No.: 292,834

[22] Filed:. Jan. 3, 1989

[51] Int. Cl.[4] ..... A45B 9/04

[52] U.S. Cl. ..... 135/77; 135/84; 135/86

[58] Field of Search ..... 135/67, 84, 86, 77

[56] References Cited

U.S. PATENT DOCUMENTS

| | | | |
|---|---|---|---|
| 960,700 | 6/1910 | Pratt | 135/84 X |
| 2,878,509 | 3/1959 | Fisher | 135/86 X |
| 3,741,226 | 6/1973 | Urban | 135/84 |
| 4,098,283 | 7/1978 | Tritle, Jr. | 135/77 |
| 4,237,915 | 12/1980 | Zabielski et al. | 135/77 X |
| 4,451,080 | 5/1984 | Nix | 135/84 X |
| 4,493,334 | 1/1985 | Semanchik et al. | 135/84 X |
| 4,708,154 | 11/1987 | Edwards | 135/84 |

FOREIGN PATENT DOCUMENTS

| | | | |
|---|---|---|---|
| 167749 | of 1950 | Austria | 135/77 |
| 149019 | of 1920 | United Kingdom | 135/86 |

*Primary Examiner*—Carl D. Friedman
*Assistant Examiner*—Lan Mai
*Attorney, Agent, or Firm*—Roger A. Marrs

[57] ABSTRACT

A walking aid is disclosed herein for use in combination with a cane, crutches or the like having a foot member provided with a centrally located base formed with a central socket for insertably receiving the tip end of the cane or crutch. The foot member is provided with several raised reinforcement ribs on its top surface that radiate outwardly between the socket and the base. The foot member is substantially rectangular in plan view having rounded corners and a plurality of ridges carried in fixed parallel spaced-apart relationship on the underside of the foot member. The opposite ends of the base curve upwardly to permit limited rolling of the foot member when used with a cane or crutch during a walking procedure.

1 Claim, 1 Drawing Sheet

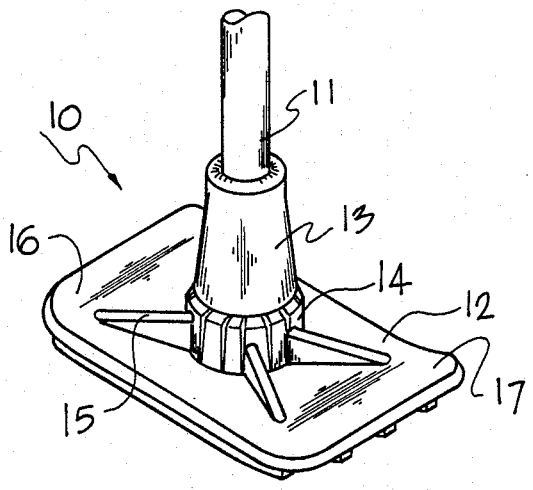
FIG. 1
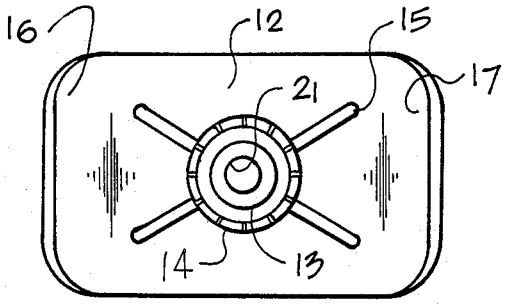
FIG. 3
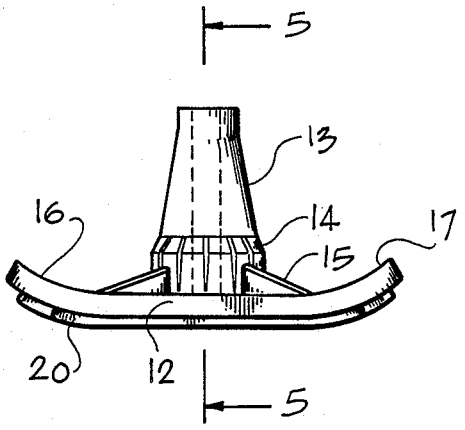
FIG. 2
FIG. 5
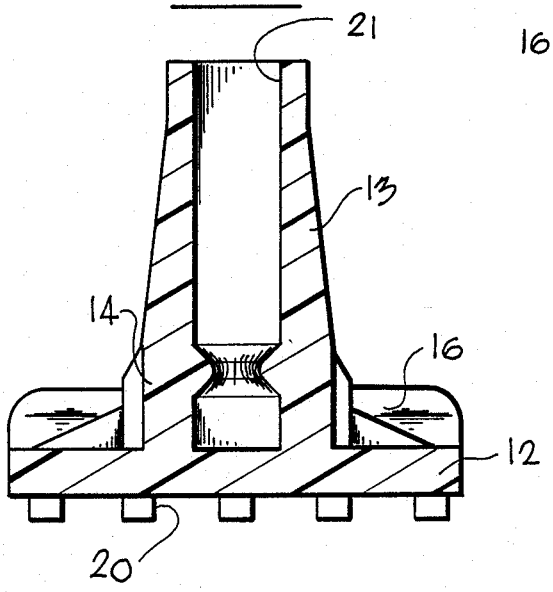
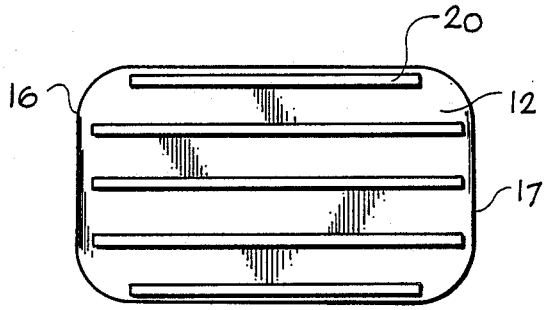
FIG. 4

WALKING AID

BACKGROUND OF THE INVENTION

1. Field of the Invention

The present invention relates to walking devices and, more particularly, to a novel walking aid which is used in combination with a cane or a crutch useful in stabilizing a person engaged in a walking procedure.

2. Brief Description of the Prior Art

In the past, it has been the conventional practice to employ a cane or crutches for assisting a person to walk. During the walking procedure, the person uses the cane to stabilize or balance himself as he travels in a forward direction using his natural legs to achieve the forward movement. The cane or the crutch is employed mainly to support his weight and to provide a stabilizing means assisting the walker to travel.

Formerly, problems and difficulties have been encountered when using conventional canes for leg walkers, crutches, or the like, which stem primarily from the fact that a substantial amount of manual dexterity and balance are required since the ground engaging portion of the assisting device, such as the cane or the crutch, provides only a small ground engaging surface. Therefore, load distribution, as well as balance, is difficult to maintain when the walker is particularly physically impaired. Futhermore, when the walker uses a four-legged stand for support, such a stand is cumbersome and requires the walker to lift the device as steps are taken. During the lifting of the device, the walker is unsupported and unstabilized.

Therefore, a long standing need has existed to provide a walking aid which may be readily used with conventional canes or crutches or the like which will provide a larger ground engaging surface in a non-skid fashion and which will roll with the forward movement of the walker during the walking procedure.

SUMMARY OF THE INVENTION

Accordingly, the above problems and difficulties are obviated by the present invention which provides a novel foot member adapted to be carried on the tip of a crutch or cane or other walking device which provides greater ground engaging area than conventionally provided. Such a walking aid comprises an elongated foot member having a top and bottom surface wherein a raised socket is integrally carried on the upper surface into which the tip of the cane or walking device is inserted. Reinforcing ribs outwardly radiate from the socket across the top of the foot member useful in reinforcing a base which is substantially rectangular in plan view. A plurality of spaced-apart parallel ridges are integrally formed on the underside of the foot member for ground engaging purposes which aid in stabilizing the device during the walking procedure. The opposite ends of the base included in the foot member are slightly curved to accommodate a rolling motion incurred during the walking procedure. Preferably, the walking aid of the invention is composed of a resilient or semi-hard material so as to provide a yieldable flexing characteristic to accommodate stresses incurred by the cane or the crutch during the walking procedure.

Therefore, it is among the primary objects of the present invention to provide a novel walking aid which may be readily installed on a conventional walking device, such as a cane, crutch, or walker, that greatly increases the ground engaging surface for increasing the support of the user and providing the user with increased balance capabilities.

Another object of the present invention is to provide a novel walking aid which will roll as the walker is moving in a forward direction and which will provide a stabilizing support for the walker during the walking procedure.

Yet another object of the present invention is to provide a novel walking aid which is relatively economical to manufacture and which may be installed by the user without the use of tools or special skills or knowledge.

Yet another object of the present invention is to provide a novel walking aid detachably connectable to the tip of a walking device, such as a cane or crutch, that will roll with the forward movement of the walker during the walking procedure and which is preferably composed of a resilient material so as to accommodate flexure when applied loads are encountered during the procedure.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a front perspective view of the novel walking aid incorporating the present invention;

FIG. 2 is a side elevational view of the walking aid shown in FIG. 1;

FIG. 3 is a top plan view of the walking aid;

FIG. 4 is a bottom plan view of the walking aid; and

FIG. 5 is a transverse cross-sectional view of the walking aid taken in the direction of arrows 5—5 of FIG. 2.

DESCRIPTION OF THE PREFERRED EMBODIMENT

Referring to FIG. 1, the novel walking aid of the present invention is illustrated in the general direction of arrow 10 which is shown installed on the end of a cane 11 representing a typical walking device. The aid 10 includes a foot member 12 having an upper surface on which a socket 13 is carried. The socket 13 terminates in an enlarged base 14 having a plurality of outwardly radiating ribs such as rib 15. The base portion 14 and ribs 15 are integrally formed with the foot member 12 so as to form a unitary piece. It is to be understood that the end of the cane 11 is inserted into a central opening into the socket 13 so that a tight frictional fit ensues whereby the walking aid 10 will be carried on the cane 11 as it is moved along by the walker during the walking procedure.

It is to be particularly noted that the foot member 12 is elongated or rectangular in plan view, as shown more clearly in FIG. 3, and that the opposite ends of the foot member are curved upwardly as indicated by numerals 16 and 17 respectively.

Referring now in detail to FIG. 2, it can be seen that the opposite ends of the foot member 12 curve upwardly and that the underside of the member is provided with a plurality of parallel, spaced-apart ridges, such as ridge 20. FIG. 4 also shows the ridge arrangement. The ridges downwardly depend from the under surface of the foot member and serve as gripping or anti-skid means to prevent slippage of the walking cane during the walking procedure.

Referring now in detail to FIGS. 2, 3, and 5, it can be seen that the socket 13 includes a central passageway or opening indicated by numeral 21 which receives the end of the walking device 11. Preferably, as particularly noted in FIG. 5, the composition of the walking aid 10 is of a hard rubber or plastic-like material which will yield to loading pressures as the cane is used in the walking procedure. The socket, base, and foot member will flex in accordance with applied loads which are encountered.

Therefore, it can be seen that the novel walking aid of the present invention provides an enlarged surface area over the surface area of the primary walking device 11. The increased surface area provides stability for balancing the user as he walks in a forward direction. The arrangement of the sleeve-like socket 13 and base 14, with respect to the end of the walking device 11, permits these latter elements to flex as the foot member rolls within a limited manner along the walking surface. The user may lift the device and place it forward in preparation for a forward step wherein the curved portion of end 16 will engage with the walking surface. As forward movement of the walker continues, his weight will shift forward and the cane or walking device 11 will locate the foot member so that it rolls on the curve of end 16 to a flat position with the central portion of the foot member engaging the ground surface. Further forward movement causes the foot member to roll on the curved end 17 as the position of the walker changes during the completion of the step.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In a walking aid for use in combination with a walking device comprising:

an elongated walking device;

a broad, flat foot member having an upper and an under surface;

an elongated socket carried centrally on said foot member upper surface projecting upwardly to terminate in an open receptacle for insertably receiving one end of said walking device;

said foot member having opposite curved ends separated by a linear mid-section permitting said foot member to roll in a limited manner during a walking procedure;

a collar base integrally joining said socket to said foot member to provide a unitary construction;

said foot member includes a plurality of parallel spaced-apart ridges downwardly depending from said under surface extending along said mid-section and said opposite curved ends;

said socket, base and said foot member are composed of a semi-resilient, yieldable material adapted to flex under applied load during the walking procedure;

a plurality of raised, elongated and parallel reinforcement ribs interconnecting said collar base with said foot member and said ribs radiating outwardly from said collar base equidistance apart; and said foot member is of substantially rectangular shape in a plan view having rounded corners with said parallel ribs extending in parallel spaced relationship with opposite sides of said rectangular shape foot member.

* * * * *